United States Patent [19]

Marforio

[11] 4,072,115

[45] Feb. 7, 1978

[54] SEWING MACHINE FOR FORMING SHAPED FABRIC BELTS

[75] Inventor: Nerino Marforio, Milan, Italy

[73] Assignee: Rockwell-Rimoldi S.p.A., Milan, Italy

[21] Appl. No.: 727,887

[22] Filed: Sept. 29, 1976

[30] Foreign Application Priority Data

Oct. 3, 1975 Italy ..... 27913/75

[51] Int. Cl.[2] ..... D05B 27/00

[52] U.S. Cl. ..... 112/205; 112/208

[58] Field of Search ..... 112/65, 209, 81, 208, 112/90, 205, 98, 211, 102, 121.24, 203; 226/117, 156, 162

[56] References Cited

U.S. PATENT DOCUMENTS

| | | | |
|---|---|---|---|
| 3,163,139 | 12/1964 | Hedegaard | 112/211 X |
| 3,198,153 | 8/1965 | Weber | 112/209 |
| 3,495,558 | 2/1970 | Dobner et al. | 112/211 |
| 3,611,817 | 10/1971 | Smith et al. | 112/209 X |
| 3,854,430 | 12/1974 | Bryan | 112/205 X |

*Primary Examiner*—Werner H. Schroeder
*Assistant Examiner*—Moshe I. Cohen

[57] ABSTRACT

An improved feeding mechanism for a sewing machine for producing shaped belts in which two needles are used to effect simultaneous stitching of each side of the belt to be formed and which utilizes separate feeding means for advancing the fabric to the needle area, the feeding means being adapted to effect different rates of advancement of the fabric in the sewing zone.

2 Claims, 2 Drawing Figures

SEWING MACHINE FOR FORMING SHAPED FABRIC BELTS

BACKGROUND OF THE INVENTION

A well known method of shaping a waistband or belt (hereinafter referred to as belt) is that of attaching the lower portion, formed to have a larger radius than the upper portion, to an article of clothing so that its assembled configuration will conform generally to the natural curve of a person's pelvis.

Shaped belts are presently formed by two pieces of fabric that correspond in both length and shape and which are sewn together by means of a single row of stitches applied to the upper and lower edges thereof.

Belts are also formed by folding an elongated and preformed section of fabric end to end and then sewing single lines of stitches along opposite sides thereof.

With both methods of shaping belts the single seams on each side are separately sewn on a sewing machine of the single needle type due to the fact that the lower line of stitches is of greater length than the upper line of stitches.

Frequently, the seam formed along the lower portion of a belt is also utilized for the purpose of attaching said belt to an article of clothing.

The present invention has substantially simplified the method of shaping a belt by providing a means whereby the upper and lower parallel lines of stitching can be simultaneously formed with a sewing machine of the double needle type.

SUMMARY OF THE INVENTION

The improved feeding machanism according to the present invention is applicable to a sewing machine having two needles which operatively associated with the machine's lower stitch forming instrumentalities are effective in simultaneously forming a single line of stitches adjacent both the upper and lower sides of a belt.

The mechanism includes first and second fabric feeding devices which are effective upon the upper and lower sides respectively of a belt.

Additionally, the first feeding device has a length of stroke movement which is different from that of the second feeding device and provides the means for forming a longer line of stitches on one side of the belt relative to the opposite side.

These and other features of the present invention will be made apparent in the course of the following description of a preferred embodiment thereof provided with reference to the accompanying drawings, in which:

DESCRIPTION OF THE PREFERRED EMBODIMENT

Figure 1:
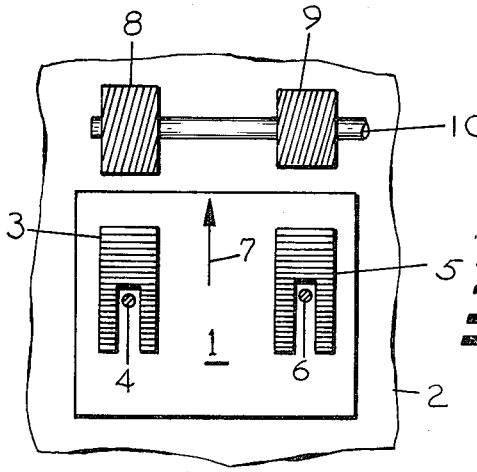
FIG. 1 is a diagrammatic view of a part of the sewing machine according to the present invention.

Referring now to FIG. 1 a throat plate 1 is shown mounted on a work bed plate 2 of a conventional sewing machine (not shown).

A first feed dog 3 disposed in operative association with a needle 4 projects from the throat plate 1 and a second feed dog 5 laterally spaced from and in alignment with said first feed dog 3 is disposed in operative association with a needle 6 both of which are effective in advancing a workpiece in the direction of the indicating arrow 7.

A first roller 8 is located rearwardly of and in alignment with the first feed dog 3 and a second roller 9 is disposed rearwardly of and in alignment with the second feed dog 5.

Both of the rollers 8 and 9 are fixed on a shaft 10 which is driven by any suitable means not shown so as to cause rotatable indexing of said rollers.

The two feed dogs 3 and 5 are independently driven in well known rectangular movements by conventional means (not shown).

The indexing movement of the first roller 8 corresponds to the feed advancement stroke of the feed dog 3 and similarly, the indexing movement of the second roller 9 corresponds to that of the feed dog 5. With both rollers being fixed on the same shaft 10, the difference in indexing movements of the rollers is accomplished by providing rollers with different diameters and, more specifically, the diameter of the roller 8 is larger than that of the roller 9.

The difference in the diameter of the rollers 8 and 9 must be proportional to the stroke difference between the two feed dogs 3 and 5.

Figure 2:
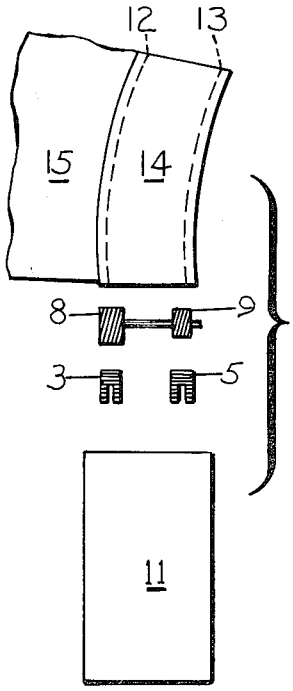
FIG. 2 is a diagrammatic view of an embodiment of a belt.

The two rollers 8 and 9 are continually urged by conventional biasing means (not shown) either toward the work bed plate 2 or underlying idle rollers (also not shown). With reference to FIG. 2, the above-described machine is adapted to form shaped belts from a rectilinear strip 11.

The strip is inserted in a well known guide means (not shown) which is adapted to fold the strip in a desired manner.

The folded strip 11 is then advanced by the feed dog 3 and the roller 8 which form a first feeding mechanism and by the feed dog 5 and the roller 9 which form a second feeding mechanism.

Two spaced lines of stitches 12 and 13 are produced by the combinations of the two feeding mechaniss, the needles 4 and 6 and the lower stitching instrumentalities (not shown). The different advancement strokes of the two feeding mechanisms cause the rectilinear strip 11, for forming a belt 14, to assume a shape in which the lower line of stitches 12 are of greater length than the upper line of stitches 13.

With the above-described apparatus it is possible to form a shaped belt 14 independently or during fabrication thereof to simultaneously attach the belt to an article of clothing 15 by means of the lower line of stitches 12.

The above-described apparatus can also be utilized to fabricate a shape belt 14 by utilizing a strip of material that has been pre-formed to produce the desired belt configuration.

With one feeding mechanism having a longer feed stroke than the other, two parallel lines of stitches can be formed simultaneously and the line of stitches adjacent the lower edge of the belt will be of greater length than the one adjacent the upper edge thereof.

In the above description specific reference has been made to belts adapted for attachment to slacks or skirts in which the lower edge is of larger diameter than the upper edge so as to conform to the body shape of the wearer.

In the case of shaped belts to be attached, for example, to bodices, in which the upper part must be of a larger diameter than the lower, the means for displacing the feed dog 3 must be such that its advancement stroke is shorter than the advancement stroke of the feed dog 5 and the diameter of the roller 8 must also be less than the diameter of the roller 9.

Accordingly, the first feeding mechanism requires a shorter feed advancement stroke than that of the second feeding mechanism.

Although the present invention has been described in connection with a preferred embodiment, it is to be understood that modifications and variations may be resorted to without departing from the spirit and scope of the invention and the appended claims.

What is claimed is:

1. An apparatus for forming shaped fabric belts in a sewing machine having a work bed plate with a throat plate mounted thereon in operative association with a pair of needles cooperating with the machines lower stitching instrumentalities to form upper and lower parallel lines of stitching in a belt, said apparatus comprising:

(a) a first feeding mechanism including:

(i) a first feed dog (3) mounted in operative association with the throat plate for stroke movements of a pre-selected length;

(ii) a first roller (8) carried by the machine adjacent said first feed dog (3) and rotatably indexed to define an advancement stroke equivalent to that of the latter;

(b) a second feeding mechanism including:

(i) a second feed dog (5) mounted in operative association with the throat plate for stroke movements of a length different from said first feed dog (3); and (ii) a second roller (9) operatively connected to said first roller (8) adjacent said second feed dog (5) and rotatably indexed to define an advancement stroke equivalent to that of the latter.

2. The apparatus according to claim 1 wherein said first and second rollers (8,9) are fixed on a shaft (10) for providing simultaneous rotational indexing thereof with said first roller (8) being of a diameter different from that of said second roller (9) for effecting movement thereof a distance corresponding to the length of the stroke of said first and second feed dogs (3,5) respectively.

* * * * *